US007182592B2

(12) United States Patent
Perez

(10) Patent No.: US 7,182,592 B2
(45) Date of Patent: Feb. 27, 2007

(54) PIEZOELECTRIC LIGHTER OF MODEL R WITH A SAFETY DEVICE

(75) Inventor: Jose Perez, Kowloon (HK)

(73) Assignee: Polyconcept Hong Kong Limited, Kowloon (HK)

( * ) Notice: Subject to any disclaimer, the term of this patent is extended or adjusted under 35 U.S.C. 154(b) by 197 days.

(21) Appl. No.: 10/990,372

(22) Filed: Nov. 18, 2004

(65) Prior Publication Data

US 2006/0035186 A1 Feb. 16, 2006

(30) Foreign Application Priority Data

Aug. 16, 2004 (CN) ..... 2004 2 0085177

(51) Int. Cl.
*F23D 11/36* (2006.01)
*F23D 14/28* (2006.01)

(52) U.S. Cl. ..... 431/153; 431/255; 431/344

(58) Field of Classification Search ..... 431/344, 431/153, 255, 254

See application file for complete search history.

(56) References Cited

U.S. PATENT DOCUMENTS 6,086,358 A * 7/2000 Potskhishvili et al. ..... 431/153
6,540,507 B1 4/2003 Yang
6,551,097 B1 * 4/2003 Huang ..... 431/153
6,604,939 B1 * 8/2003 Li ..... 431/153
6,641,389 B1 * 11/2003 Huang ..... 431/153
6,669,465 B2 * 12/2003 Yang ..... 431/153
6,682,341 B2 * 1/2004 Pan et al. ..... 431/153
6,962,493 B2 * 11/2005 Luo ..... 431/153
2002/0132201 A1 9/2002 Zhang

* cited by examiner

*Primary Examiner*—Josiah C. Cocks
*Assistant Examiner*—Chuka C Ndubizu
(74) *Attorney, Agent, or Firm*—Rabin & Berdo, P.C.

(57) ABSTRACT

A piezoelectric lighter of model R with a safety device includes a casing, a storage, a gas emitting nozzle, a piezoelectric unit, a fixed cover, and a safety device. The safety device comprises a blocking stopper; an ignition cap having a cover, a guiding groove and a guiding aperture; a safety button comprising a button portion, a locking arm, a spring and a guiding retaining shaft that is movably arranged in the guiding aperture to push by the spring force the safety button right to form a locked position that the blocking stopper is located in the traveling way of the locking arm; only if the button portion is pushed left, the locking arm is moved away from the stopper to form an unlocked position that the blocking up is released to ignite the piezoelectric lighter.

3 Claims, 2 Drawing Sheets

PIEZOELECTRIC LIGHTER OF MODEL R WITH A SAFETY DEVICE

BACKGROUND OF THE INVENTION

1. Field of the Invention

The present invention relates to a piezoelectric lighter, and more particularly to a piezoelectric lighter of model R with a safety device.

2. Description of Related Art

Some piezoelectric lighters are provided with a safety lock so as to prevent the piezoelectric lighters from being ignited accidentally or by children at playing. The safety lock blocks an ignition cap of the piezoelectric lighter by a button, the ignition cap cannot therefore be moved. When igniting, there is a need to pre-operate the button to unlock the ignition cap before sliding down the ignition cap to ignite the piezoelectric lighter.

U.S. Patent Publication No. 2002/0132201A1 discloses a safety piezoelectric lighter having a safety arrangement which includes an ignition cap having a locker cavity; a locking unit comprising a locking latch extended from an inner wall of the casing and a locker arm disposed in the locker cavity of the ignition cap; an operation button comprising a slider locker slidably mounted on the ignition cap for moving the locker arm to an unlocked position; a resilient element disposed in the receiving cavity for applying an urging pressure against the locker arm so as to normally retain the locker arm in a locking position that the locker arm is biased against the locker latch to block up the ignition cap from being slid downwardly for ignition. In the unlocked position, the locker arm is moved away from the locking latch, so that the ignition cap is capable of being slid downwardly to ignite the piezoelectric lighter.

Another piezoelectric lighter with a safety lock is disclosed in U.S. Pat. No. 6,540,507 to John Jiin Chung Yang. The safety lock includes an ignition cap slidably mounted on the casing in a radially movable manner, a blocking stopper supported in the ignition cavity, a locking member including a locking latch disposed the ignition cavity and extended to a position that the locking latch is blocked by the blocking stopper, so as to lock up the ignition cap from ignition. In the unlocked position of the safety lock, the locking latch is moved away from the blocking stopper so as to release the blocking up of the ignition cap with respect to the blocking stopper, so that the ignition cap is capable of being slid sidewardly and downwardly to ignite the piezoelectric lighter.

The safety locks as mentioned above can eliminate an accidental ignition of the piezoelectric lighter to provide a protection against fire. However, all the locks are designed for a slide-down ignition piezoelectric lighter composed of a piezoelectric unit and a rectangular casing characterized in that its height is much greater than its width, so that multiple locking or unlocking elements or units can be arranged in the ignition cap.

SUMMARY OF THE INVENTION

A main object of the present invention is to provide a piezoelectric lighter of model R with a safety device, i.e. a piezoelectric lighter of model R which is provided with a safety lock to block up the ignition motion of the ignition cap in order to prevent any sudden or unwanted ignition of the piezoelectric lighter.

In achieving the above object, the piezoelectric lighter of model R with a safety device according to the invention includes:

a casing formed as a flat cylinder with an upper opening;

a liquefied gas storage in the form similar to the casing, provided in a middle rear portion of an upper wall thereof with an installation channel that is arranged at an angle to the longitudinal axis OO' of the storage, a pair of first supporting bases which have a respective first axle hole being formed at the opposite walls of the installation channel and a second supporting base which has a second axle hole being formed at a rear portion of the upper wall of the storage behind the installation channel; and provided at a front portion of the upper side thereof with a block pole extended vertically upwards and having a end recess defined at a top end of the block pole;

a gas emitting nozzle installed on and communicated with the liquefied gas storage for controlling a flow of gas;

a gas lever which is a slab having a notch at its front end and a pair of prongs at its rear end and which is buckled between the gas emitting nozzle and the block pole through said notch and prongs, respectively;

a piezoelectric unit comprising a piezoelectric member in the form of a frame, an movable operating element extended upwards from the piezoelectric member and an ignition tip, said piezoelectric unit being received in the installation channel of the liquefied gas storage wherein the movable operating element protrudes from the upper wall of the liquefied gas storage, the ignition tip is extended to a position that gets close to the gas emitting nozzle;

a fixed cap having a streamline projecting front cover, an opening-shaped sunken seat and a pair of legs extended vertically and located symmetrically below a connection frame connecting the front cover and the sunken seat, said fixed cover being installed on the supporting bases of the liquefied gas storage through a first axle and disposed on the casing to define an ignition cavity between the fixed cap and the liquefied gas storage;

a safety device comprising:

a blocking stopper arranged vertically at the upper wall of the storage between the first supporting bases and the second supporting base;

an ignition cap having a streamline cover, a pair of inverted L-shaped arms extended outwardly from a front end of the cover, a pair of holders extended vertically downwards from a lower rear portion of the cover, a guiding groove mounted on a surface of the cover, and a guiding aperture disposed at a front end face of the ignition cap between the inverted L-shaped arms, said ignition cap being mounted in an inwardly and downwardly rotatable manner on the second supporting base through a second axle to allow its inverted L-shaped arms to be buckled at two sides of the block pole and to be opposite to the prongs of the gas lever in a up-down straight line, as well as to allow a lower front portion of its cover to rest on the operating element of the piezoelectric unit;

a safety button comprising a sliding plate, a button portion formed on a top surface of the sliding plate, a locking arm extended downwards from a bottom surface of the sliding plate, and a guiding retaining shaft extended vertically from a front end face of the sliding plate, said safety button being received inside the ignition cap in such a manner that the button portion is capable of being shifted up and down in the guiding groove and the guiding retaining shaft is capable of movably passing through the guiding aperture;

a spring provided on the guiding retaining shaft and located between the front end face of the sliding plate of the safety button and the front portion of the cover of the ignition cap, said spring in a free state allowing by virtue of the spring force the safety button to be biased against or pushed towards the right side so that the locking arm of the safety button stands opposite to or comes into contact with the blocking stopper in a straight line, whereby, when pressing down the safety button and the button portion by a thumb force, the safety button can not be moved downwardly to form a locked position that the stopper is located in the traveling way of the locking arm; only if the button portion is pushed by the thumb force towards the front cover of the fixed cap, the locking arm is deviated from and moved away from the blocking stopper to form an unlocked position that the blocking up is released with respect to the blocking stopper, so that the piezoelectric lighter can be subsequently ignited by pressing down the ignition cap.

In the piezoelectric lighter of model R with a safety device as mentioned above, said blocking stopper has an end face which is a surface inclined down and left, said locking arm has a bottom end face which is a surface inclined up and right, both inclined surfaces being at an angle of 90°.

In the piezoelectric lighter of model R with a safety device as mentioned above, said safety device further has a supporting board, on the surface of which there are a lateral opening and an installation hole and which is mounted inside the cover of the ignition cap by a screwnail, while the locking arm passes through the lateral opening wherein the locking arm is capable of being shifted right and left to provide a support for the sliding plate of the safety button.

In the above piezoelectric lighter of model R with a safety device as mentioned above, said casing is made of metallic materials by punching.

According to the present invention, the piezoelectric lighter of model R model has a safety device wherein a blocking stopper is arranged vertically on the upper wall of the storage between the first supporting bases and the second supporting base, a guiding groove and a guiding aperture are provided in the ignition cap, and a safety button comprising a sliding plate, a button portion, a locking arm and a retaining shaft is used. The safety button may be biased against or pushed towards the right side by a spring to allow the locking arm of the safety button to be in a up-down straight line opposite to or come into contact with the blocking stopper of the storage, whereby, when pressing down the button portion by the thumb force only, the ignition cap can not be moved downwardly to form a locked position that the ignition motion or operation is blocked up; only if the button portion is pushed towards the front portion of the lighter or towards the left side (to eliminate the spring force), the locking arm is deviated from the relative contact with the blocking stopper in a up-down straight line or is moved away from the blocking stopper to form an unlocked position that the blocking up is released, whereupon the safety button is pressed down to ignite the piezoelectric lighter at the time of pushing the button portion left by the thumb force.

The advantages of the piezoelectric lighter according to the invention are compact and simple structure, high safety and reliability without increased volume even if the lighter is fitted with the safety device.

The above and other objects, advantages and novel features of the invention will become more apparent from the following detailed description with reference to the accompanying drawings.

DETAILED DESCRIPTION OF THE PREFERRED EMBODIMENT

Figure 1:
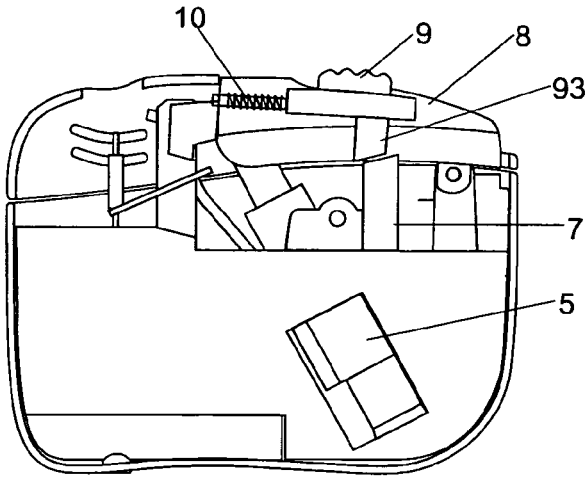
FIG. 1 is a partially sectional view of a piezoelectric lighter of model R with a safety device according to the present invention, showing the relationship of a ignition cap, a safety button and a piezoelectric unit therein in a static or locked position.
Figure 3:
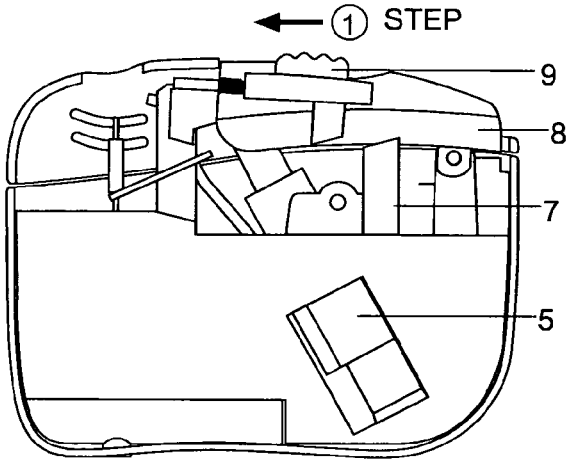
FIG. 3 is an operation step for the piezoelectric lighter of Model R according to the present invention, showing a partially sectional view that the safety button of the piezoelectric lighter is pushed left by the thumb force.
Figure 4:
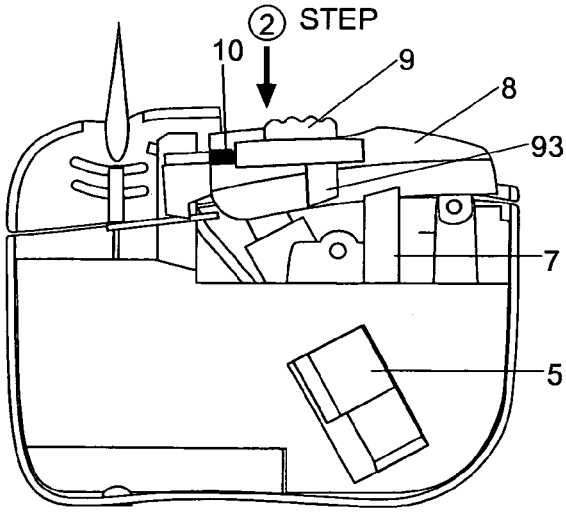
FIG. 4 is a second operation step for the piezoelectric lighter of Model R according to the present invention, showing a partially sectional view that the ignition cap is pressed down to ignite the lighter at the same time of pushing the safety button left as shown in FIG. 3.
Figure 2:
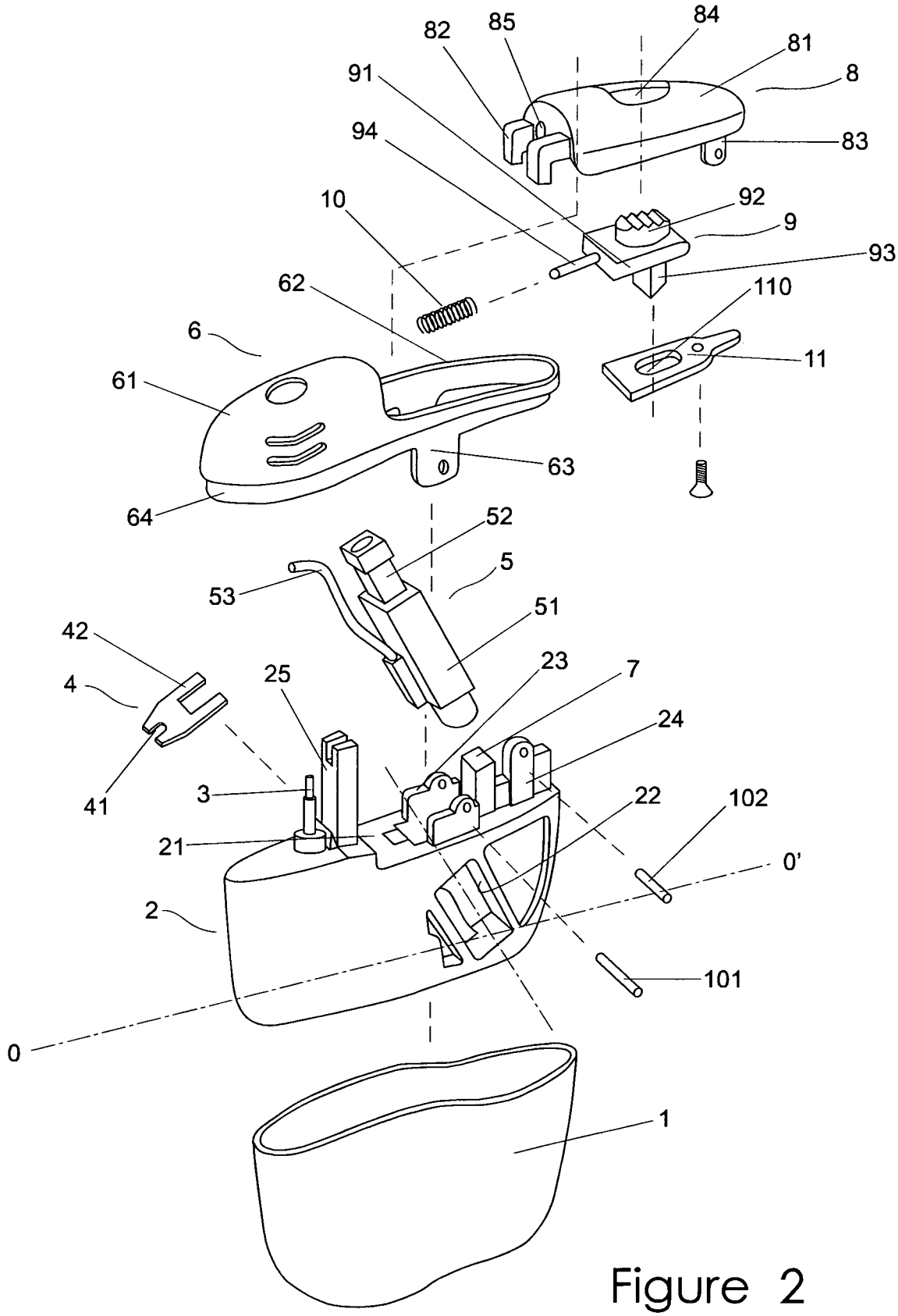
FIG. 2 is an exploded perspective view of parts of the piezoelectric lighter of model R with a safety device as shown in FIG. 1.

With reference to FIGS. 1 and 2, a piezoelectric lighter of model R with a safety device in accordance with a preferred embodiment of the present invention is illustrated, which comprises a casing 1, a liquefied gas storage 2, a gas emitting nozzle 3, a gas lever 4, a piezoelectric unit 5, a fixed cover 6, a safety device comprising a blocking stopper 7, an ignition cap 8, a safety button 9 and a spring 10.

The casing 1 is a flat cylinder with an upper opening for receiving the liquefied gas storage 2. The casing 1 can be made of metallic materials by punching.

The liquefied gas storage 2 is cylindric similar to the casing 1 in order to be received in the casing 1 in a slidable manner. The liquefied gas storage is provided in a middle rear portion of an upper wall 21 thereof with an installation channel 22 that is arranged at an angle to the longitudinal axis of the storage, a pair of first supporting bases 23 which have a respective first axle hole being formed at the opposite walls of the installation channel 22 and a second supporting base 24 which has a second axle hole being formed at a rear portion of the upper wall of the storage behind the installation channel; and provided at a front portion of the upper wall 21 thereof with a block pole 25 extended vertically upwards and having a end recess defined at a top end of the block pole.

The gas emitting nozzle 3 is installed on and communicated with the liquefied gas storage 2 for controlling a flow of the gas.

The gas lever 4 is formed as a slab, having a notch 41 at its front end and a pair of prongs 42 at its rear end. The gas lever 4 is clamped onto the gas emitting nozzle 3 by the notch 41, and the prongs 42 are buckled between the block pole 25 in such a manner that the gas emitting nozzle 3 is lifted up by the notch 41 when applying an urging pressure against the prongs 42 for the purpose of controlling the liquefied gas emitted from the gas emitting nozzle 3.

The piezoelectric unit 5 comprises a piezoelectric member 51, a movable operating element 52 extended upwards from the piezoelectric member 51 and an ignition tip 53. The piezoelectric member 51, in the form of a frame, is received in the installation channel 22 of the liquefied gas storage 2 wherein the operating element 52 protrudes from the upper wall 21 of the liquefied gas storage 2, the ignition tip 53 is extended from a lower portion of the piezoelectric unit to a position that gets close to the gas emitting nozzle 3 and is fixed and retained by the recess of the block pole 25. When the movable operating element 52 is pressed down with respect to the piezoelectric member 51, the ignition tip 53 generates a spark to ignite the gas emitted from the gas emitting nozzle 3.

The fixed cap 6 comprises a streamline projecting front cover 61 having a fire hole, an opening-shaped sunken seat 62 and a pair of legs 63 extended vertically and located symmetrically below a connection frame each having an axle hole, all of which are connected integrally by the connection frame 64. The fixed cap 6 is installed on the first supporting bases 23 of the liquefied gas storage through the first axle 101 and engaged with the opening edges of the casing 1 by means of the connection frame 64, defining an ignition cavity between the front cover 61 of the fixed cap 6 and the upper wall 21 of the liquefied gas storage 2.

In the safety device, the blocking stopper 7 is formed by a vertical extension portion of the upper wall 21 of the gas storage 2 between the first supporting bases 23 and the second supporting base 24, having a height substantially larger than that of the first supporting base 23.

The ignition cap 8 comprises a streamline cover 81, a pair of inverted L-shaped arms 82 extended outwardly from a front end of the cover 81, a pair of holders 83 extended vertically downwards from a lower rear portion of the cover 81 each having a third axle hole 83, a guiding groove 84 mounted on the surface of the cover 81, and a guiding aperture 85 disposed at the front end of the cover 81 between the inverted L-shaped arms 82. The ignition cap 8 is rotatablely mounted on the second supporting base 24 of the storage through the second axle 102 to allow its inverted L-shaped arms 82 to be buckled at two sides of the block pole 25 and to be opposite to the prongs 42 of the gas lever 4 in a up-down straight line or to rest on the prongs 42.

The safety button 9 comprises a sliding plate 91, a button portion 92 formed on a top surface of the sliding plate 91 and tending to a front portion of the top surface, a locking arm 93 extended vertically downwards from a bottom surface of the sliding plate 91, and a guiding retaining shaft 94 perpendicular to a front end face of the sliding plate 91. The safety button 9 is received in the ignition cap 8 in such a manner that the button portion 92 is capable of being shifted up and down or slid left and right in the guiding groove 84 of the ignition cap, that the guiding retaining shaft 94 runs through and is shifted along the guiding aperture 85. Preferably, the button portion 92 is provided with slot cuts to prevent slipping during pressing or pushing the button portion 92.

The spring 10 is provided on the guiding retaining shaft 94 and located between the front end face of the sliding plate 91 of the safety button 9 and the front portion of the cover 81 of the ignition cap 8. The spring has the spring force which, in a free state, pushes the safety button 9 towards the right side of the guiding groove 84 to deviate from the center of the guiding groove 84. Also, the spring allows the locking arm 93 of the safety button to be opposite to in a straight line or come into contact in a up-down manner with the blocking stopper 7 of the gas storage 2, whereby, when pressing down the safety button and/or the button portion by the thumb force only, the safety button can not be moved downwardly to form a locked position that the stopper 7 is located in the traveling way of the locking arm 93; only if the button portion 92 is pushed by the thumb force towards the front cover 61 of the fixed cap 6, the locking arm 93 is deviated from or moved away from the blocking stopper to form an unlocked position that the blocking up is released with respect to the blocking stopper, so that the ignition cap 8 may be rotated or shifted downwardly to ignite the piezoelectric lighter.

Preferably, the blocking stopper 7 has an end face inclined left and down, the locking arm 93 has an end face inclined right and up. The two inclined faces are complementary angles that add up to the sum of 90° so as to facilitate the locking arm 93 to be slidably moved away from the stopper 7 when pushing the button portion 92.

In another preferred embodiment, the safety device of the piezoelectric lighter further has a supporting board 11 which is designed to have an opening 110 the locking arm can run therethrough and be laterally shifted therein, and an installation hole. The supporting board 11 is mounted inside the cover (the bottom of the cover) of the ignition cap 8 by a screwnail to provide a support for the horizontal traveling of the sliding plate 91 of the safety button 9.

According to the invention, a process for operating the piezoelectric lighter comprises two operation steps. The first step is to apply a thumb on the button portion 92 of the safety button to push by the thumb force the safety button 9 left or towards the front cover 61 of the fixed cover 6, as shown in FIG. 1, wherein the spring force of the safety button 9 against the spring 10 is compressed to release the locking arm 93 with respect to the blocking stopper 7, which means the safety button 9 is moved from right to left, i.e. from the locked position to the unlocked position that the blocking up is released.

The second step is carried out on the basis of the first step. While maintaining to push the button portion 92 by the thumb force, the ignition cap 8 is pressed down, as shown in FIG. 2, wherein the ignition cap 8 rotates about the second axle 102 of the second supporting base 24, simultaneously, the inverted L-shaped arms 82 and the front portion of the cover 81 respectively act on the prongs 42 of the gas lever 4 and the operating element 52 of the piezoelectric unit 5, allowing the prongs 42 and the operating element 5 to be pushed towards their terminal positions to ignite the piezoelectric lighter.

After the completion of the ignition procedure, the thumb force applied on both the button portion 92 and the ignition cap 8 is released. The ignition cap 8 and the button portion 92 will return by the spring force back to the initial positions as shown in FIG. 1, i.e. the locked position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A piezoelectric lighter of model R with a safety device, comprising:

a casing formed as a flat cylinder with an upper opening;

a liquefied gas storage having a form similar to the casing, and including:

an installation channel provided in a middle rear portion of an upper wall of the gas storage, the installation channel being arranged at an acute angle relative to a longitudinal axis O of the gas storage;

a pair of first supporting bases, each of which has a respective first axle hole, and being formed at opposite walls of the installation channel;

a second supporting base which has a second axle hole, and being formed at a rear portion of the upper wall of the gas storage behind the installation channel; and a block pole provided at a front portion of the upper wall of the gas storage, the block pole extending vertically upwards and having an end recess defined at a top end thereof;

a gas emitting nozzle installed on and communicating with the liquefied gas storage for controlling a flow of gas;

a gas lever which is a slab having a notch at its front end and a pair of prongs at its rear end, and which is buckled between the gas emitting nozzle and the block pole through said notch and prongs, respectively;

a piezoelectric unit comprising a piezoelectric member in the form of a frame, a movable operating element extended upwards from the piezoelectric member, and an ignition tip, said piezoelectric member being received in the installation channel of the liquefied gas storage so as to be disposed at the acute angle, the movable operating element protruding from the upper wall of the liquefied gas storages, and the ignition tip is extended to a position adjacent to said gas emitting nozzle, wherein when said movable operating element is pressed down with respect to said piezoelectric member, said ignition tip generates a spark to ignite the gas emitted from the gas emitting nozzle;

a fixed cap having a streamline projecting front cover, an opening-shaped sunken seat, and a pair of legs extended vertically and located symmetrically below a connection frame connecting the front cover and the sunken seat, said fixed cap being installed on the first supporting bases of the liquefied gas storage through a first axle and being disposed on the casing to define an ignition cavity between the fixed cap and the liquefied gas storage; and a safety device, comprising:

a blocking stopper arranged vertically at the upper wall of the gas storage between the first supporting bases and the second supporting base;

an ignition cap having a streamline cover, a pair of inverted L-shaped arms extended outwardly from a front end of the cover, a pair of holders extended vertically downwards from a lower rear portion of the cover, a guiding groove formed on a surface of the cover, and a guiding aperture disposed at a front end face of the ignition cap between the inverted L-shaped arms, said ignition cap being mounted in an inwardly and downwardly rotatable manner on the second supporting base through a second axle to allow the inverted L-shaped arms to be buckled at two sides of the block pole and to be opposite to the prongs of the gas lever in an up-down straight line, as well as to allow a lower front portion of the cover to rest on the operating element of the piezoelectric unit;

a safety button comprising a sliding plate, a button portion formed on a top surface of the sliding plate, a locking arm extended downwards from a bottom surface of the sliding plate, and a guiding retaining shaft extended vertically from a front end face of the sliding plate, said safety button being received inside the ignition cap in such a manner that the button portion is capable of being shifted up and down in the guiding groove and the guiding retaining shaft is capable of movably passing through the guiding aperture;

a spring provided on the guiding retaining shaft and located between the front end face of the sliding plate of the safety button and the front portion of the cover of the ignition cap, said spring, in a free state, allowing by virtue of a spring force the safety button to be biased against or pushed towards a right side so that the locking arm of the safety button stands opposite to or comes into contact with the blocking stopper in a straight line, whereby, when pressing down the safety button and the button portion by a thumb force, the safety button is in a locked position, and can not be moved downwardly due to the blocking stopper being located in a traveling way of the locking arm; and only when the button portion is pushed by the thumb force towards the front cover of the fixed cap, the locking arm is deviated from and moved away from the blocking stopper to an unlocked position, in which the blocking up is released with respect to the blocking stopper, so that the piezoelectric lighter can be subsequently ignited by pressing down the ignition cap, thereby causing the ignition cap to rotate about the second axle; and a supporting board, on which there is a lateral opening and an installation hole and which is mounted inside the cover of the ignition cap by a screwnail, the locking arm passing through the lateral opening, wherein the locking arm is capable of being shifted right and left to provide a support for the sliding plate of the safety button.

2. The piezoelectric lighter of model R with a safety device as claimed in claim 1, wherein said blocking stopper has an end face which is a surface inclined down and left, said locking arm has a bottom end face which is a surface inclined up and right, the inclined surfaces being at complimentary angles adding up to a sum of 90°.

3. The piezoelectric lighter of model R with a safety device as claimed in claim 1, wherein said casing is made of metallic materials by punching.

* * * * *